United States Patent [19]

Husmann

[11] Patent Number: 4,947,964

[45] Date of Patent: Aug. 14, 1990

[54] DOOR DRIVE APPARATUS WITH LOCKING MECHANISM FOR ELEVATORS

[75] Inventor: Josef Husmann, Lucerne, Switzerland

[73] Assignee: Inventio AG, Switzerland

[21] Appl. No.: 322,959

[22] Filed: Mar. 13, 1989

[30] Foreign Application Priority Data

Mar. 18, 1988 [CH] Switzerland ..... 01051/88

[51] Int. Cl.[5] ..... B66B 13/00

[52] U.S. Cl. ..... 187/52 LC; 187/61; 49/118

[58] Field of Search ..... 187/57, 52 R, 61, 52 LC, 187/51; 49/360, 73, 116, 118, 120, 121

[56] References Cited

U.S. PATENT DOCUMENTS

| | | | |
|---|---|---|---|
| 2,003,399 | 6/1935 | Tamsitt | 187/52 LC |
| 2,960,188 | 11/1960 | Schweig | 187/52 LC |
| 3,605,952 | 9/1971 | Lusti | 187/51 |
| 3,783,977 | 1/1974 | Voser | 187/52 LC |

FOREIGN PATENT DOCUMENTS

| | | |
|---|---|---|
| 452210 | 8/1974 | Australia . |
| 0164581 | 12/1985 | European Pat. Off. . |
| 481836 | 11/1969 | Switzerland . |
| 523199 | 5/1972 | Switzerland . |
| 663405 | 12/1987 | Switzerland . |
| 663406 | 12/1987 | Switzerland . |
| 2071203 | 9/1981 | United Kingdom . |

*Primary Examiner*—Michael S. Huppert
*Assistant Examiner*—Kenneth Noland
*Attorney, Agent, or Firm*—Marshall & Melhorn

[57] ABSTRACT

An apparatus for opening and closing the car door of an elevator car which is situated in the door opening zone of a floor is coupled together with a shaft door, and is driven automatically by a drive motor or, in the case of a power failure, manually by a passenger. If the elevator car is situated outside a door opening zone, the car door remains locked by the same apparatus. The car door is driven through a drive belt by way of an entraining parallelogram linkage, which linkage includes a rigid cam and a movable cam and is mounted at the upper part of a car door. For free travel through a door opening zone, the linkage is closed, and the linkage opens for the coupling with the shaft door between two coupling rollers mounted on the shaft door before a movement of the doors takes place. The movable cam includes a compressible ramp cam which, during the travel and on stopping outside a door opening zone, lifts off from a rigid cam carrier due to leaf springs. On the coupling with the coupling rollers of a shaft door, the ramp cam is pressed against the rigid cam carrier for the unlocking of a car door bolt. The linkage is connected to the drive belt by an actuating lever which cooperates with a pair of abutments to define the open and closed positions of the linkage.

11 Claims, 3 Drawing Sheets

DOOR DRIVE APPARATUS WITH LOCKING MECHANISM FOR ELEVATORS

BACKGROUND OF THE INVENTION

The present invention relates generally to an apparatus for driving elevator doors and, in particular, to a door drive apparatus with a door locking mechanism.

It is well known to provide an elevator car with a door drive apparatus to open and close the car door and the elevator shaft door at a floor. The door drive apparatus can include a shaft door coupling mechanism including an entraining parallelogram linkage mounted on a car door section and two coupling rollers positioned at each shaft door. A drive means mounted above the car door drives an actuating lever which is coupled to the linkage to move the car door between the closed and the open positions. A locking mechanism includes a pivotably mounted car door bolt which is monitored by a safety contact, is arrestable at an abutment, is locked by its own weight in a retaining position and which is urgeable into a releasing position by a control roller running up onto a control cam.

A door drive apparatus of the type described above is shown in Swiss Pat. No. 663,406, in which the shaft door is moved with the car door of an elevator car situated in the door opening zone of a floor. The doors are lockingly connected with each other by an entraining parallelogram linkage which is mounted on the car door and is movable by two entraining members mounted on the shaft door. A pivotably attached car door bolt is mounted on the car door and is locked by its own weight at an abutment on the car. In the door opening zone of a target floor, the bolt is unlocked by the running up of a first control roller, which is positioned adjacent an angle lever articulatedly connected with the bolt, onto a control cam positioned at each floor, wherein the coupled doors in normal operation are automatically opened and again closed by the door drive apparatus.

In the case of a power failure, the car door remains locked outside the door opening zone. In the door opening zone, the entraining parallelogram linkage is drawn apart by the force of a tension spring, wherein the door drive apparatus is guided out of a dead center position with the aid of a double lever and a second control roller. Also, the locked car door is unlocked by the impinging of the first control roller on the control cam at the floor and the movement connected therewith of the angle lever and the articulated bolt. The car door and the coupled shaft door then can be opened by hand.

A disadvantage of this apparatus is that a control cam for the unlocking of the car door is required at each floor, which control cam must cooperate exactly at each floor with the drive apparatus mounted on the car and therefore requires exact and expensive installation at the building site. A further disadvantage is that the entraining parallelogram linkage in the open position can be compressed by external forces or inertia forces, whereby disturbing noises are generated.

SUMMARY OF THE INVENTION

The present invention concerns a door drive apparatus with a locking mechanism for the operation of elevator car doors. The disadvantages of the previously known door drive devices, as explained above, are overcome and eliminated by the present invention. The advantages achieved by the present invention are essentially that the unlocking control cams at each floor have been eliminated and the entraining parallelogram linkage can not be compressed by external or inertia forces.

A single actuating cam positioned on a movable cam of the entraining parallelogram linkage and a control roller mounted on the car door bolt suffice to unlock the car door bolt in the door opening zone of a floor, while they do not influence the car door locking outside the door opening zones.

Another advantage of the invention is that the exact degree of splaying of the entraining parallelogram linkage, which is required for the desired functioning of the linkage, is adjustable through the pivot angle of the actuating lever pivoting between two fixed abutments. The adjustment is made through two parts of the actuating lever, which are each displaceable relative to the other. Thus, it is possible during the factory assembly to set the exact manner of function of the entraining parallelogram linkage rather than be required to make such adjustments at the time of installation in a building.

A further advantage of the invention is the that entraining parallelogram linkage locking mechanism has a locking pawl which is carried in a rest position by a support roller When the car door is unlocked and after a minimum opening movement of the car door and the shaft door, the locking pawl tilts due to the force of a torsion spring and, in the open state, is locked with the set degree of splaying. The actuating elements of the locking mechanism are arranged so that no wedging is possible even in the case of an inaccurate lateral car position.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
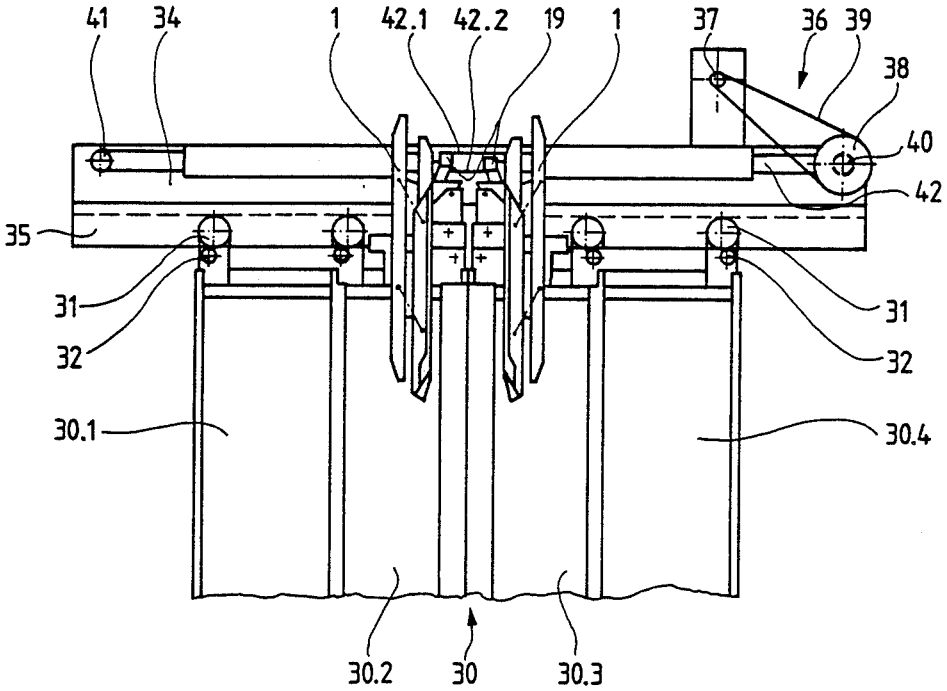
FIG. 1 is a front elevation view of a door drive apparatus with a centrally opening center-telescopic sliding elevator car door, the door suspensions and the entraining parallelogram linkages, in accordance with the present invention.
Figure 2:
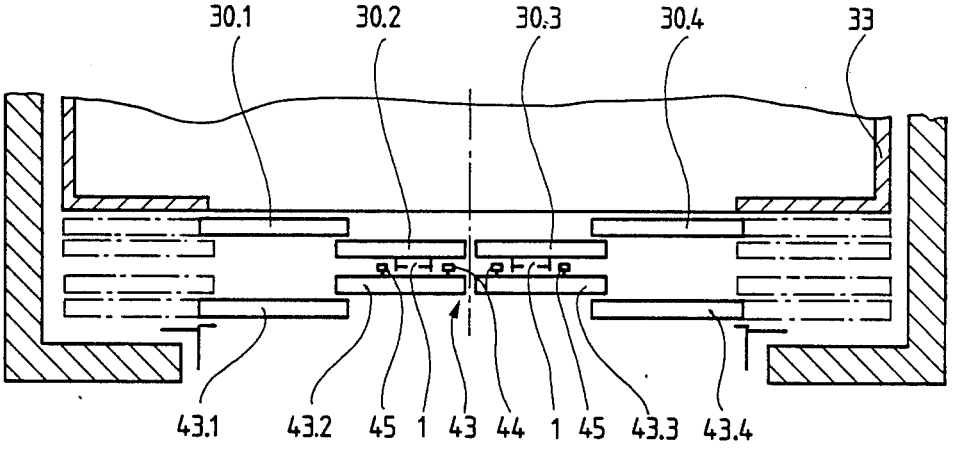
FIG. 2 is a top plan view of the door drive apparatus according to FIG. 1 together with a shaft door closure.

An entraining parallelogram linkage 1 for a coupling mechanism between a car door 30 and a shaft or hoistway door 43 of a door drive apparatus of an elevator installation is shown in the FIGS. 1 and 2. The entraining parallelogram linkage 1 is positioned at the upper part of the car door 30 and is connected to a drive belt 42 by a clamping element 19. The drive belt 42 is a part of a drive means 36 of the door drive apparatus which also includes a drive motor 37 coupled to a connecting gear 38 by a drive belt 39 and two rollers. The drive means 36 is mounted on a generally horizontally extending sheet metal carrier 34, which carrier is positioned at the roof of a car 33 above the door opening. At the opposite ends of the carrier, a fixed drive roller 40 and a tensionable adjustable roller 41 are rotatably attached and retain the drive belt 42 with the required tension.

According to the direction of movement of the car door 30, the clamping element 19 of the entraining parallelogram linkage 1 can be clamped fast selectively either at the upper run 42.1 or at the lower run 42.2 of the drive belt 42 as explained below. Fastened below the sheet metal carrier 34 is a guide carrier 35 which rotatably mounts carrier rollers 31 and guide rollers 32 adjacent the upper edge of the car door 30 for guiding movement of the car door. The car door 30 and the shaft door 43 are illustrated as centrally opening center-telescopic doors with the car door including sections 30.1, 30.2, 30.3 and 30.4 and the shaft door including sections 43.1, 43.2, 43.3 and 43.4, respectively from left to right. A fixed coupling roller 44 and a movable coupling roller 45 are mounted on the shaft door 43 for transmission of the door movement from the car door 30 to the shaft door. The movable coupling roller 45 at the same time serves for unlocking or for locking of the shaft door 43, wherein a not illustrated safety contact also monitors the locking electrically.

The entraining parallelogram linkage 1 is shown in more detail in the FIGS. 3, 4, 5 and 6. The clamping element 19 is articulately connected with an actuating lever 9 and a parallel extending strap 18 of the linkage 1. The linkage 1 also includes a rigid cam 2 and a movable cam 3 which are formed as generally vertically extending, elongated bars. The cams 2 and 3 are articulately connected with a fixed base plate 10 and are parallelly pivotable through coupling to opposite ends of a lower lever 7 and an upper lever 8. The base plate 10 is fixedly mounted on the upper part of the car door 30. The movable cam 3 includes a rigid cam carrier 4 pivotally attached to the lower lever 7 and to the upper lever 8. The cam 3 also includes a ramp cam 5 which is parallelly compressible with respect to and slightly spaced from the rigid cam carrier 4 by leaf springs 6. The entraining parallelogram linkage 1 is either drawn apart into an open position (FIG. 4), by a tension spring 11 pivotally connected between the right end of the upper lever 8 and the right end of the base plate 10, or drawn together into a closed position (FIG. 3) by the drive belt 42.

The clamping element 19 is pivotally connected to the upper end of the actuating lever 9 which extends from the center of the upper lever 8, and also is pivotally connected to the upper end of the strap 18 which has its lower end pivotally connected to the base plate 10. The levers 7 and 8 are also pivotally connected to the base plate 10 at their centers such that the levers 7 and 8, the cams 3 and 4, and the lever 9 and the strap 18 are guided as parallel pairs movable by the clamping element 19. As shown in FIG. 1, the clamping element 19 for the left side of the car door 30 is clamped to the upper run 42.1 and the clamping element 19 for the right side of the car door 30 is clamped to the lower run 42.2 of the drive belt 42, but the connections could be reversed depending upon the direction of movement of the drive belt 42 with respect to the desired direction of movement of the car door sections. Each element 19 serves as the binding link between the associated entraining parallelogram linkage 1 and the drive belt 42. The open position of the linkage 1 is limited by an abutment 16 mounted on the base plate 10 and the closed position is limited by an abutment 17 likewise mounted on the base plate 10. The exact pivot angle for the attainment of the aforedescribed opening width or degree of splaying of the entraining parallelogram linkage 1 can be adjusted selectively through a displacement of the actuating lever 9 with respect to the upper lever 8.

Figure 6:
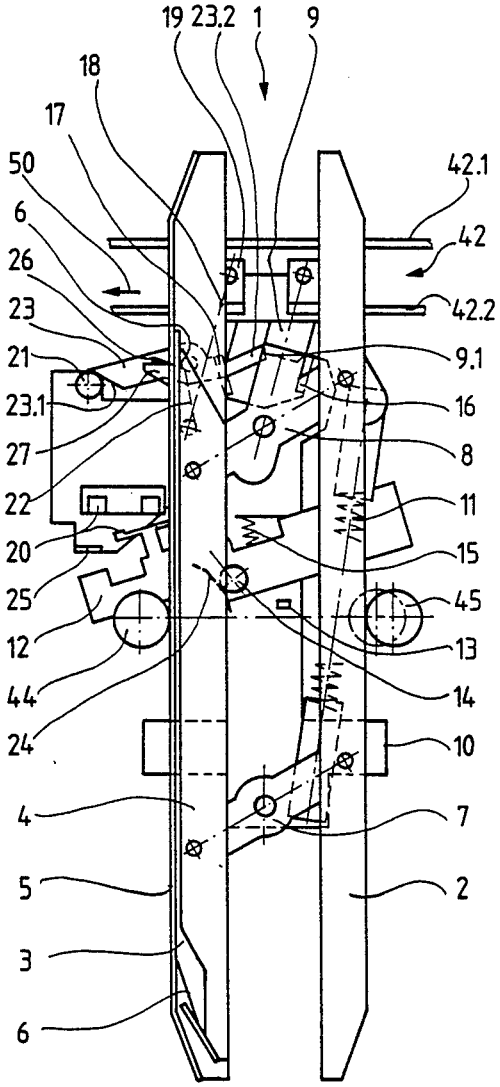
FIG. 6 is a front elevation view of the entraining parallelogram linkage of FIG. 3 at a target floor with a compressed movable cam, the shaft and car doors unlocked and opened a predetermined distance, and a locking pawl locked to the linkage.

A car door bolt 12, which through its own weight and through a compression spring 15 attached to the base plate 10, rests in a rest position on an abutment 13 mounted on the base plate 10, is pivotally connected to the base plate 10. In the rest position, the car door bolt 12 is locked with an abutment 25 mounted on the car 33. Fastened to the car door bolt 12 is a control roller 14 which cooperates with a control cam 24 mounted on the ramp cam 5 of the movable cam 3 and unlocks the car door bolt 12 when the entraining parallelogram linkage 1 is coupled with the fixed coupling roller 44 and the movable coupling roller 45 of the shaft door 43. The locked rest position of the car door bolt 12 is monitored electrically by a safety contact 20. A locking pawl 23, which is biased by the force of a torsion spring 22, is pivotally mounted at one end on the base plate 10. A support roller 21 mounted on the car 33 presses the locking pawl 23 into an unlocked position against the force of the torsion spring 22 when the car door 30 is locked. As shown in FIG. 6, immediately after the opening of the car door 30, an inclined edge 23.1 of the locking pawl 23 rolls over the support roller 21, during which the locking pawl 23 tilts until an abutment pin 26 on the end of the torsion spring 22 contacts a lug 27 on the base plate 10 and a rear part 23.2 of the locking pawl 23 abuts a bevel 9.1 of the actuating lever 9 and locks the entraining parallelogram linkage 1 in the opened position.

The aforedescribed equipment operates as follows: The centrally opening telescopic door, illustrated by way of example in the FIGS. 1 and 2, consists of two two-section telescopic doors. On the opening of the car door 30, two door sections 30.1 and 30.2 or 30.3 and 30.4, one beside the other, move from the center either to the left or to the right respectively. Although not shown, a known operating mechanism indirectly drives the outer door sections 30.1 and 30.4 at half the speed for half the travel of the inner, directly driven door sections 30.2 and 30.2 so that both the door sections 30.1 and 30.2 or 30.3 and 30.4, which belong together, lie exactly congruently one behind the other outside the car door opening when the car door 30 is open. The individual car door sections are moved in guides of the guide carrier 35. The common drive means 36, mounted on the sheet metal carrier 34 above the guide carrier 35 at the cage roof, drives both of the middle car door sections 30.2 and 30.3. The drive belt 42 has the upper run 42.1 clamped to the entraining parallelogram linkage 1 of the left hand middle car door section 30.2 and has the lower run 42.2 clamped to the entraining parallelogram linkage 1 of the right hand middle car door section 30.3. The drive belt 42 is driven by the drive motor 37 by way of the drive belt 39, the connecting gear 38 and the fixed drive roller 40. The fastening of the entraining parallelogram linkage 1 to the drive belt 42 and the manner of function of the linkage 1 is more clearly evident from the FIGS. 3, 4, 5 and 6.

Figure 3:
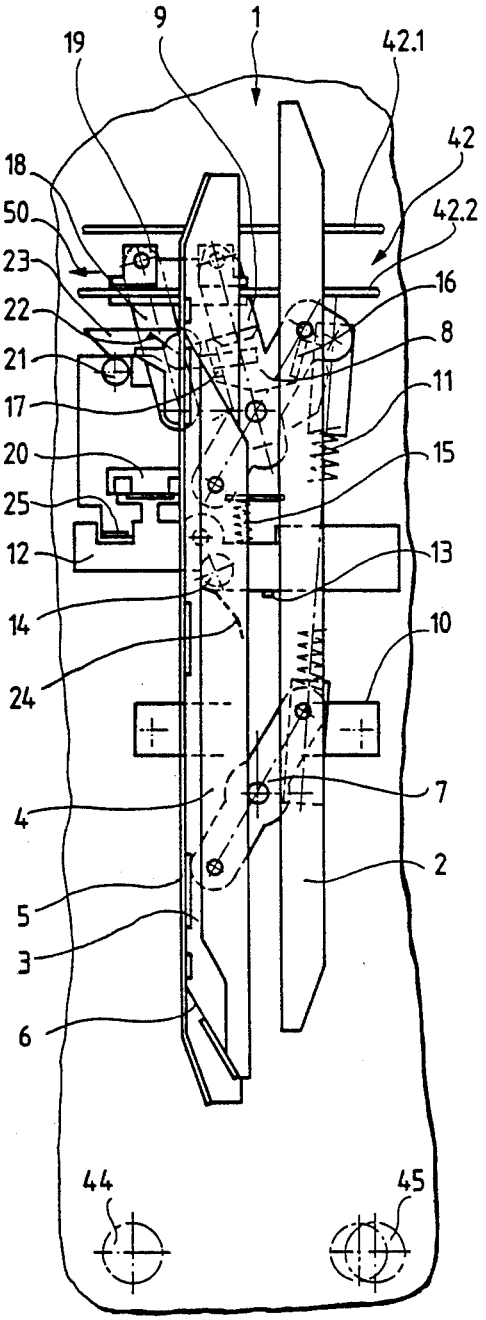
FIG. 3 is an enlarged front elevation view of one entraining parallelogram linkage of FIG. 1 in a closed position for the free travel of the elevator car past a floor at which no stop is scheduled.
Figure 4:
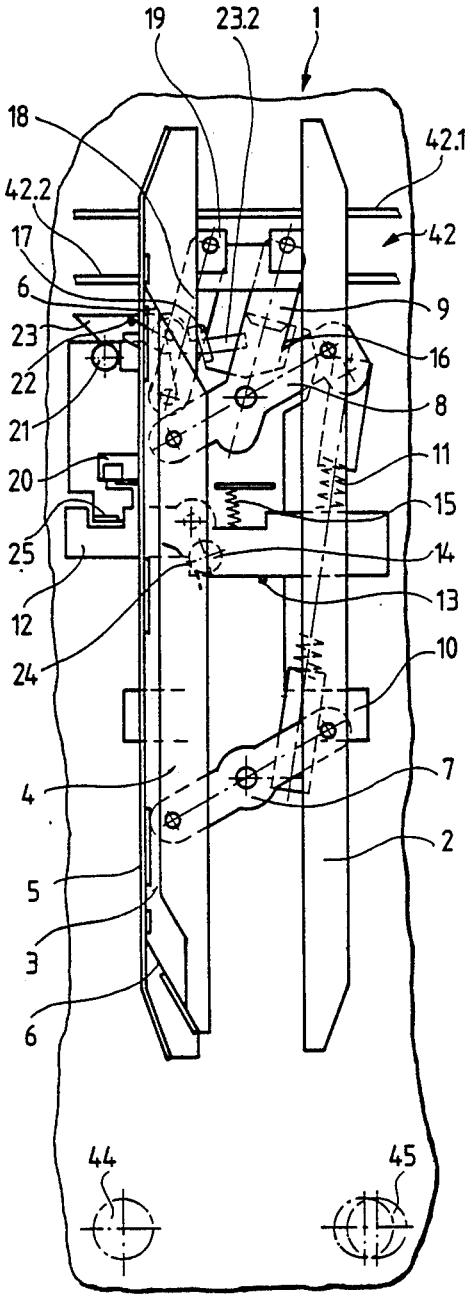
FIG. 4 is a front elevation view of the entraining parallelogram linkage of FIG. 3 outside a door opening zone with locked car and shaft doors.

The entraining parallelogram linkage 1, which is firmly attached to the upper part of the associated car door sections 30.2 and 30.3 by means of the base plate 10, has the task of keeping the car door 30 locked during the car travel. Furthermore, at a target floor, the linkage 1 also has the task of unlocking the car door 30 and the shaft door 43, and coupling them together in order that the shaft door 43 is opened and closed together with the car door 30 actuated by the door drive means 36, and both doors are subsequently again locked. Additionally, certain regulations require that in the case of a power failure, the car door must remain locked outside a door opening zone at a floor and that the car door and the corresponding shaft door must be unlocked automatically in the door opening zones of the floors in order that the car door together with the shaft door can be opened manually by an enclosed passenger. The FIG. 3 shows the closed position of the entraining parallelogram linkage 1 during the movement of the car past floors. The FIG. 4 shows the open position in the case of power failure with the car door 30 locked outside a door opening zone. The FIGS. 5 and 6 show the open position in normal operation at a floor, or in the case of power failure with an unlocked car door 30 within the door opening zone of the floor.

The clamping element 19, which according to FIG. 3 is clamped fast to the drive belt 42, holds the entraining parallelogram linkage 1 in the closed position against the force of the tension spring 11 and also holds the car door 30 itself closed due to a holding force 50 acting along the lower run 42.2 of the drive belt 42 when the drive motor 37 is switched off and blocked by a not illustrated retaining brake. The clamping element 19 acting under tension stress draws the articulated actuating lever 9 of the upper lever 8 flush against the abutment 17 of the base plate 10 so that the rigid cam 2 and the movable cam 3 assume their narrowest setting when the ramp cam 5 is away from the rigid cam carrier 4 due to the leaf springs 6. The control roller 14 and the control cam 24 of the car door bolt 12 do not touch each other and the car door bolt 12, due to its own weight and the force of the compression spring 15, lies on the abutment 13. The car door 30 is locked at the abutment 25 by the car door bolt 12 and the safety contact 20 is closed. The unlocked locking pawl 23 of the entraining parallelogram linkage 1 rests in its rest position on the support roller 21 against the force of the torsion spring 22. In this position, closed for the travel of the car 33, the entraining parallelogram linkage 1 moves through the door opening zone of an untargeted floor without contact between the fixed coupling roller 44 and the movable coupling roller 45 of the shaft door 43.

In the case of a stop of the car 33 outside the door opening zone of a floor, for example in case of a power failure, according to the FIG. 4., the tension force through a run 42.1 or 42.2 of the drive belt 42 at the clamping element 19 disappears due to the lack of power to the drive motor 37. The tension force of the tension spring 11 tilts the actuating lever 9 from the abutment 17 to the abutment 16 of the base plate 10. The clamping element 19 in that case executes an idle stroke in a parallel displacement to the right together with the clamped-on drive belt 42 with the car door 30 remaining stationary. The rigid cam 2 and the movable cam 3 of the entraining parallelogram linkage 1 assume the open position, the compressible ramp cam 5 remains spaced from the rigid cam carrier 4 by the leaf springs 6, and the control cam 24 and the control roller 14 of the car door bolt 12 do not touch each other. The car door 30 remains locked due to the car door bolt 12 contacting the abutment 25 and the locking pawl 23 remains in its rest position relative to the entraining parallelogram linkage 1.

Figure 5:
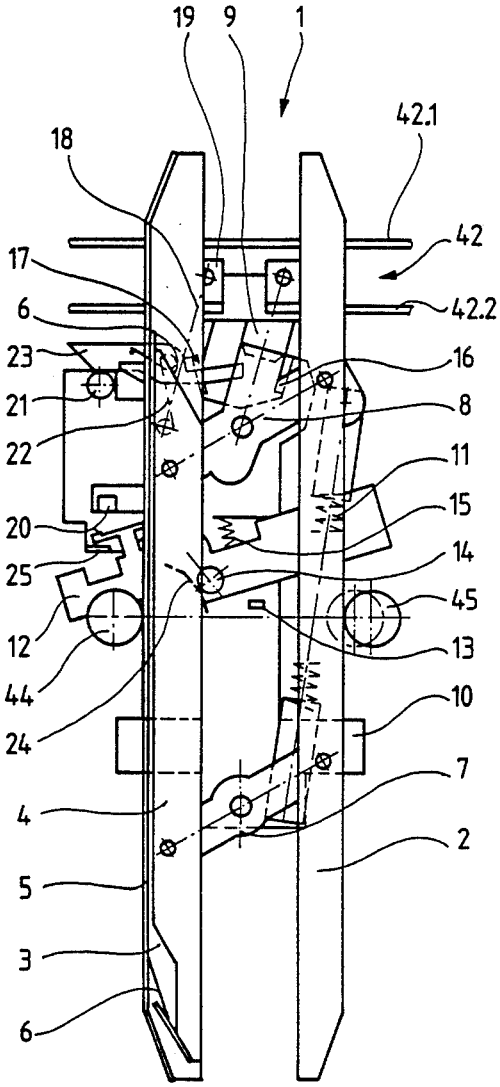
FIG. 5 is a front elevation view of the entraining parallelogram linkage of FIG. 3 at a target floor with a compressed movable cam, and the shaft and car doors unlocked and closed.

In the case of a targeted stop or an unintended stop within the door opening zone of a floor, according to the FIGS. 5 and 6, the entraining parallelogram linkage 1 moves between the fixed coupling roller 44 and the movable coupling roller 45 of the shaft door 43. The entraining parallelogram linkage 1 is splayed apart in the opening direction by the tension force of the tension spring 11 either when the drive motor 37 is free of power or on the switching-over of the drive motor 37 regulated by a microprocessor. The clamping element 19 clamped on the drive belt 42 together with the drive belt 42 carries out a pivotal movement through the actuating lever 9 when the car door 30 is stationary, for which movement the fixed cam 2 and the movable cam 3 open parallelly and engage the coupling rollers 44 and 45 of the shaft door 43. In that case, the movable coupling roller 45 is moved away through a predetermined distance and the shaft door 43 is unlocked. The movable ramp cam 5 is moved against the rigid cam carrier 4, while the control roller 14 runs up on the control cam 24, the car door bolt 12 is pressed out of its rest position and the car door 30 is unlocked. The car door 30 is now either opened by the door drive means 36 or can be pushed open by hand.

At the beginning of the opening movement, the locking pawl 23 rolls along on the supporting roller 21 and after a few millimeters tilts, due to a force applied by the torsion spring 22, downwardly over the inclined edge 23.1 until the abutment pin 26 of the torsion spring 22 contacts the lug 27 of the base plate 10 (FIG. 6). The rear part 23.2 of the locking pawl 23 contacts the bevel 9.1 of the actuating lever 9 and the entraining parallelogram linkage 1 is locked in the opened position. The further opening movement and the subsequent closing movement of the car door 30 and the coupled shaft door 43 take place with the entraining parallelogram linkage 1 locked, whereby vibrations and rattling noises during the door movements are avoided.

At the end of the closing movement, the car door 30, which is moved according to FIG. 6 by way of the locked entraining parallelogram linkage 1 clamped to the lower run 42.1 driven by the door drive means 36, is pulled together with the shaft door 43 until it stands against a not illustrated abutment. In that case, the locking pawl 23 runs by way of the inclined edge 23.1 onto the supporting roller 21, the entraining parallelogram linkage 1 becomes unlocked and, when the car door 30 is stationary, the linkage 1 closes itself due to the tension force of the drive belt 42. The actuating lever 9 pivots from the abutment 16 for the open position of the entraining parallelogram linkage 1 to the abutment 17 for the closed position and the rigid cam 2 and the movable cam 3 move away from the movable coupling roller 45 and the fixed coupling roller 44, respectively, of the shaft door 43. Due to the return movement of the movable coupling roller 45, the shaft door 43 is locked and the not illustrated safety contact is closed. The compressible ramp cam 5 moves away from the rigid cam carrier 4 due to the leaf springs 6, while the control cam 24 moves away from the control roller 14 and the car door bolt 12 moves into its horizontal rest position, whereby the car door 30 is locked and the safety contact 20 is closed (FIG. 3). The car is then ready for further travel.

Although a centrally opening center-telescopic door with four door sections is illustrated in the FIGS. 1 and 2, any other type of sliding door can be equipped with the door drive apparatus according to the invention. Furthermore, the drive belt 42 could be provided with another drive means, for example a crank drive.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A door drive apparatus with locking mechanism for elevators having a car door movable by a drive means and in the door opening zone of floors connectable through a coupling mechanism with a shaft door, wherein the coupling mechanism includes an entraining parallelogram linkage mounted on a car door section and two coupling rollers respectively positioned at each shaft door, the drive means includes a drive motor mounted above the car driving a connecting gear which drives a drive belt which is connected with the car door through an actuating lever and fixes the car door in the closed and in the open positions, and the locking mechanism includes a pivotably mounted car door bolt which is monitored by a safety contact, is arrestable at an abutment, is locked by its own weight in a retaining position and which is urgeable into a releasing position by a control roller running up onto a control cam, comprising:

an actuating lever pivotably mounted on an elevator car door and having one end articulately connected with a drive means for the car door and an opposite end coupled to an entraining parallelogram linkage;

said entraining parallelogram linkage including a rigid cam and a movable cam, said movable cam having a rigid cam carrier and a ramp cam spaced from said rigid cam carrier by spring means, said ramp cam being compressible parallelly with respect to said rigid cam carrier, a control cam for a locking mechanism of the car door is connected to said ramp cam and a control roller is mounted on a car door bolt, and said car door bolt is pivotably mounted on a base plate for mounting the entraining parallelogram linkage on the car door; and a pair of spaced apart abutments on the car door for limiting the pivotal movement of said actuating lever and defining open and closed positions of the linkage for coupling the car door to the shaft door thereby transmitting the movement of the car door to the shaft door.

2. The door drive apparatus according to claim 1 wherein said actuating lever is adjustably connected with an upper lever of the entraining parallelogram linkage.

3. A door drive apparatus with locking mechanism for elevators having a car door movable by a drive means and in the door opening zone of floors connectable through a coupling mechanism with a shaft door, wherein the coupling mechanism includes an entraining parallelogram linkage mounted on a car door section and two coupling rollers respectively positioned at each shaft door, the drive means includes a drive motor mounted above the car driving a connecting gear which drives a drive belt which is connected with the car door through an actuating lever and fixes the car door in the closed and in the open positions, and the locking mechanism includes a pivotably mounted car door bolt which is monitored by a safety contact, is arrestable at an abutment, is locked by its own weight in a retaining position and which is urgeable into a releasing position by a control roller running up onto a control cam, comprising:

an actuating lever pivotably mounted on an elevator car door and having one end articulately connected with a drive means for the car door and an opposite end coupled to an entraining parallelogram linkage;

a pair of spaced apart abutments on the car door for limiting the pivotal movement of said actuating lever and defining open and closed positions of the linkage for coupling the car door to the shaft door thereby transmitting the movement of the car door to the shaft door; and a locking pawl pivotally mounted on the car door and held in a rest position against a support roller by a torsion spring, said support roller and said torsion spring mounted on the car and said torsion spring having one end attached to said locking pawl for moving said locking pawl to a locking position of the entraining parallelogram linkage after the opening of the car door.

4. The door drive apparatus according to claim 3 wherein said actuating lever is adjustable connected with an upper lever of the entraining parallelogram linkage.

5. A door drive apparatus with locking mechanism for elevators having a car door movable by a drive means and in the door opening zone of floors connectable through a coupling mechanism with a shaft door, wherein the coupling mechanism includes an entraining parallelogram linkage mounted on a car door section and two coupling rollers respectively positioned at each shaft door, the drive means includes a drive motor mounted above the car driving a connecting gear which drives a drive belt which is connected with the car door through an actuating lever and fixes the car door in the closed and in the open positions, and the locking mechanism includes a pivotably mounted car door bolt which is monitored by a safety contact, is arrestable at an abutment, is locked by its own weight in a retaining position and which is urgeable into a releasing position by a control roller running up onto a control cam, comprising:

an actuating lever pivotably mounted on an elevator car door and having one end articulately connected with a drive means for the car door and an opposite end coupled to an entraining parallelogram linkage;

a pair of spaced apart abutments on the car door for limiting the pivotal movement of said actuating lever and defining open and closed positions of the linkage for coupling the car door to the shaft door thereby transmitting the movement of the car door to the shaft door; and a clamping element articulately connected to said actuating lever and clamped to a drive belt of the drive means for the car door.

6. The door drive apparatus according to claim 5 including a strap parallelly guiding said clamping element and having one end articulately connected to said clamping element and an opposite end pivotally connected to the car door.

7. The door drive apparatus according to claim 6 wherein said clamping element is clampable selectively to an upper run and a lower run of said drive belt.

8. The door drive apparatus according to claim 5 wherein said actuating lever is adjustably connected with an upper lever of the entraining parallelogram linkage.

9. An apparatus for driving the door of an elevator car, comprising:

a drive means mounted on an elevator car above a car door;

an actuating lever coupled to said drive means;

an entraining parallelogram linkage mounted on the car door and connected to said actuating lever, said entraining parallelogram linkage including a rigid cam and a movable cam, said movable cam having a rigid cam carrier and a ramp cam spaced from said rigid cam carrier by spring means, said ramp cam being compressible parallelly with respect to said rigid cam carrier, a control cam for a locking mechanism of the car door is connected to said ramp cam and a control roller is mounted on a car door bolt, and said car door bolt is pivotably mounted on a base plate for mounting the entraining parallelogram linkage on the car door; and abutment means mounted on the car door for limiting the movement of said actuating lever to define open and closed positions of said linkage.

10. The apparatus according to claim 9 wherein said actuating lever is adjustably connected with an upper lever of said linkage for selectively defining said open and closed positions of said linkage.

11. The apparatus according to claim 9 including a locking pawl pivotably mounted on the car door and held in a rest position against a support roller by a torsion spring, said support roller and said torsion spring mounted on the car and said torsion spring having one end attached to said locking pawl for moving said locking pawl to a locking position of said entraining parallelogram linkage after the opening of the car door.

* * * * *